US006651360B1

(12) United States Patent
Lind

(10) Patent No.: US 6,651,360 B1
(45) **Date of Patent: *Nov. 25, 2003**

(54) BOWLING SHOE WITH SOLE HAVING REGIONS OF DIFFERENT COEFFICIENTS OF FRICTION

(75) Inventor: Jeffrey R. Lind, 460 165th Ave., Somerset, WI (US) 54025

(73) Assignee: Jeffrey R. Lind, Somerset, WI (US)

( * ) Notice: Subject to any disclaimer, the term of this patent is extended or adjusted under 35 U.S.C. 154(b) by 187 days.

This patent is subject to a terminal disclaimer.

(21) Appl. No.: 09/747,077

(22) Filed: Dec. 21, 2000

Related U.S. Application Data

(62) Division of application No. 09/329,513, filed on Jun. 10, 1999, now Pat. No. 6,243,973.

(51) Int. Cl.[7] ..... A43B 5/00
(52) U.S. Cl. ..... 36/130; 36/15
(58) Field of Search ..... 36/15, 100, 101, 36/130

(56) References Cited

U.S. PATENT DOCUMENTS

| | | | | |
|---|---|---|---|---|
| 638,879 A | | 12/1899 | Packard | |
| 1,904,886 A | | 4/1933 | Selva | |
| 1,967,334 A | | 7/1934 | Sothen | |
| 2,325,741 A | | 8/1943 | Chertok | |
| 2,395,218 A | * | 2/1946 | Gauthier | |
| 2,416,526 A | * | 2/1947 | Koenig | |
| 2,640,283 A | | 6/1953 | McCord | |
| 2,648,916 A | * | 8/1953 | Greissinger | |
| 3,027,661 A | | 4/1962 | McCord | |
| 3,538,628 A | | 11/1970 | Einstein, Jr. | 36/15 |
| 3,561,140 A | | 2/1971 | Ludwig | |
| 3,672,077 A | | 6/1972 | Coles | 36/2.5 T |
| 3,693,269 A | | 9/1972 | Guarrera | |
| 3,903,620 A | | 9/1975 | Gillet | |
| 4,041,618 A | * | 8/1977 | Famolare, Jr. | |
| 4,267,650 A | | 5/1981 | Bauer | |
| 4,279,083 A | | 7/1981 | Dilg | 36/101 |
| 4,317,294 A | | 3/1982 | Goodyear | 36/100 |
| 4,716,664 A | | 1/1988 | Taylor | 36/114 |
| 5,542,198 A | | 8/1996 | Famolare | 36/130 |
| 5,661,915 A | | 9/1997 | Smith | 36/15 |

FOREIGN PATENT DOCUMENTS

| | | |
|---|---|---|
| FR | 488133 | 9/1918 |
| GB | 21714 | 11/1930 |
| IT | 526565 | 5/1955 |

* cited by examiner

*Primary Examiner*—Marie Patterson
(74) *Attorney, Agent, or Firm*—Gray, Plant, Mooty, Mooty & Bennett, P.A.; Malcolm D. Reid; Cecilia Jaisle

(57) ABSTRACT

A wedge-soled bowling shoe has selectable percentages of regions of different coefficients of friction of traction characteristics and different coefficients of friction of slide characteristics on a shoe sole surface. The shoe gives the bowler precise control over relative amounts of slide and/or traction action of each shoe. The bowler can readily change the relative amounts of slide and/or traction action of each shoe by changing a replaceable sole member of the desired percentages of regions of high or low traction and high or low slide to accommodate differing conditions and differing styles of bowling. Using one of a plurality of pairs of replaceable sole members, a first member of each pair is constructed of two materials, each of a different coefficient of friction to provide slide characteristics and a second member of each pair is constructed of two materials, each of a different coefficient of friction to provide traction characteristics. Changing the replaceable sole member changes the relative slide and/or traction on the bowling shoe sole and allows either shoe of a pair to be determined as the slide or traction shoe.

25 Claims, 3 Drawing Sheets

BOWLING SHOE WITH SOLE HAVING REGIONS OF DIFFERENT COEFFICIENTS OF FRICTION

CROSS-REFERENCE TO RELATED PATENT APPLICATION

This application is a continuation of application of Ser. No. 09/329,513, filed Jun. 10, 1999 now U.S. Pat. No. 6,243,973.

FIELD OF THE INVENTION

The present invention is directed to a method of providing selectable relative amounts of regions of traction or slide on a wedge-soled bowling shoe surface, and to a wedge-soled bowling shoe constructed in accordance therewith. The bowling shoe of this invention allows the bowler, among other features to be later described, more precise control over relative amounts of slide or traction action of each shoe. In addition, the bowler can readily change the relative amounts of slide or traction action of each shoe by simply interchanging a replaceable sole member of the desired amount of regions of high or low traction. The change can be individually selected by the bowler for differing conditions and for differing styles of bowling. The present bowling shoe can be configured for either a right- or left-handed bowler by simply selecting the appropriate replaceable sole member. The manufacturer and distributor can reduce inventory, while still meeting varied customer needs.

BACKGROUND OF THE INVENTION

Among the variables that require consideration in the design and manufacturer of bowling shoes are individual bowling style, the left- or right-handedness of the bowler, the preferred relative amounts of slide and traction for each shoe of a pair, and the surface conditions of the bowler's shoes in relationship to the bowling lane. Accurate approach to the foul line and precise delivery of the ball generally require that the bowler have the ability to control the slide action and the traction action of each foot independently. Several attempts have been made to construct bowling shoes based on a standard shoe type with a separate raised heel and an arch elevated from the floor or lane surface. Selectable control of the sole surface to meet the individual bowler's preference then requires specific designs to the separate ball-of-the-sole and the heel regions. Often, manufacturers provide small inserts of varying coefficients of friction materials, so that the bowler must keep track of a confusing number of separate sole attachments. Current bowling shoes are constructed so that a single pair can fit only a left- or right-handed bowler. Although only a relatively small number of bowlers may be left-handed, to meet the needs of all potential customers, inventory must be maintained in all sizes for both left- and right-handed bowlers. This contributes to an unacceptable amount of waste and ultimately increases the cost of the shoe to the bowler.

Typically, a pair of bowling shoes may include a slide shoe and a traction shoe, determined by the bowler's left- or right-handedness. The sole surface of the slide shoe is generally selected for relative slide action with a sole at least partly comprised of a material with a lower coefficient of friction, for example, natural or synthetic leather, or leather substitutes, including natural or synthetic suede or buckskin leather. The sole surface of the traction shoe is generally selected for good relative traction with a sole at least partly comprised of a material with a higher coefficient of friction, for example, natural or synthetic rubber or rubber substitutes.

McCord, U.S. Pat. No. 2,640,283, issued May 10, 1952, and McCord, U.S. Pat. No. 3,027,661, issued Apr. 3, 1962, each relate to a bowling shoe with a sole insert that extends generally along the ball of the foot. One insert may be exchanged for another, and each insert has a different coefficient of friction. The inserts shown in the '283 patent each have extending tangs which interfit with slots in the permanent sole area of the shoe. The inserts shown in the '661 patent attach by means of a hook-and-loop material. Note that the entire permanent area of the sole has a single coefficient of friction surface, and that each insert has a single coefficient of friction surface.

Cohen, U.S. Pat. No. 3,672,077, issued Jun. 27, 1972, is directed to a bowling shoe with removable cleats attached to apertures in the sole. Each of the cleats may have a single different coefficient of friction, so that by selecting specific cleats, it is said that the bowler may obtain the desired low or high traction characteristics for the sole. Note that the entire permanent area of the sole has a single coefficient of friction surface, and that each insert has a single coefficient of friction surface.

Taylor, U.S. Pat. No. 4,716,664, issued Jan. 5, 1988, describes a bowling shoe that has a specifically designed heel with different outer and inner bottom surfaces. The outer bottom heel surface has a relatively high coefficient of friction as compared to the inner heel surface. The shoe for the non-sliding foot has a sole with a higher coefficient of friction and a conventional uniform heel surface. Note that the individualization is only to the slide shoe and that the traction shoe is of a traditional style. According to Taylor, a single pair of shoes can only be designed for a right handed bowler or for a left handed bowler and only with a single type of slide action is provided to the slide shoe.

Famolare, U.S. Pat. No. 5,542,198, issued Aug. 6, 1996, relates to a bowling shoe, in which the shoe sole has a replaceable slide pad only on the tread surface of a shoe with a standard raised heel. The slide pad extends from the toe end of the shoe sole to about the arch portion and extends across the width of the tread surface. The removable slide pad that has a peripheral margin about equal to the peripheral margin of the slide area on the tread surface. The heel also has separate selectively replaceable heels, to provide a different desired coefficient of friction to the heel. Note that each insert (to the ball region or the heel region) has only a single coefficient of friction surface. Note also that the replaceable portion of the sole is only provided on the slide shoe. No selectability is provided for the traction shoe, nor does Famolare allow for changing the left- or right-handedness of a pair of shoes by interchanging the replaceable slide area.

These and other bowling shoe constructions have been proposed and are currently available. None of them provide all of the advantages of the present invention, including, among other features described herein, selectability of amounts of regions of different coefficients of friction of the sole surface. None of these prior bowling shoes offer a wedge-soled shoe with selectable areas of slide or traction over the entire sole surface. None of these prior bowling shoe arrangements have the ability to designate either shoe to be the "slide" shoe or the "traction" shoe simply by applying a selected replaceable sole member to the shoe, thus changing the left-/right-handedness of the pair of shoes.

BRIEF DESCRIPTION OF THE INVENTION

The present invention is a wedge-soled bowling shoe with a replaceable sole member. The shoe comprises a shoe upper, a wedge sole mounted to the shoe upper, and a plurality of replaceable sole members. The wedge sole has a replaceable sole member receiving area. The replaceable sole member receiving area extends from the toe to the heel of the wedge sole. Each of the plurality of replaceable sole members has two surface regions. A first region is of a higher coefficient of friction material and a second region is of a lower coefficient of friction material. A sole with a relatively greater percentage of higher to lower coefficient of friction materials on its surface will have relatively more traction characteristics of the pair, while a sole with a relatively greater percentage of lower to higher coefficient of friction materials on its surface will have relatively more slide characteristics of the pair. Thus, in a pair of shoes of this invention a first replaceable sole member of a pair has two regions of different coefficients of friction to provide slide characteristics to the sole, and a second replaceable sole member of the pair has two regions of different coefficients of friction to provide traction characteristics to the sole. Each replaceable sole member is sized and shaped to the replaceable sole member receiving area. The mating faces of the replaceable sole member and the replaceable sole member receiving area are removably secured to each other, such as by a hook-and-loop material or by adhesive. Securing to the shoe a replaceable sole member with two regions of different coefficients of friction to provide traction characteristics to the sole designates that shoe as the traction shoe of a pair. Securing to the shoe a replaceable sole member with two regions of different coefficients of friction to provide slide characteristics to the sole designates that shoe as the slide shoe of a pair.

Each of the plurality of replaceable sole members of this invention has two surface regions. A first region is of a higher coefficient of friction material and a second region is of a lower coefficient of friction material. A sole with a relatively greater amount of higher to lower coefficient of friction materials on its surface will have relatively more traction characteristics, while a sole with a relatively greater amount of lower to higher coefficient of friction materials on its surface will have relatively more slide characteristics. Thus, in a pair of replaceable sole members of this invention a first member of the pair has two regions of different coefficients of friction to provide slide characteristics, and a second member of the pair has two regions of different coefficients of friction to provide traction characteristics. Each replaceable sole member is sized and shaped to the replaceable sole member receiving area. The mating faces of the replaceable sole member and the replaceable sole member receiving area are removably secured to each other, such as by a hook-and-loop material or by adhesive.

The wedge sole may have a permanent sole area in addition to the replaceable sole member receiving area. The permanent sole area may have a single surface region of a single coefficient of friction material, or it may have two surface regions, a first region of the higher coefficient of friction material extending from the heel and a second region of the lower coefficient of friction material extending from the toe. The replaceable sole member and the permanent sole area are preferably co-planar with each other. The replaceable sole member may be of two separately attachable sections, a first section corresponding to the first region and a second section corresponding to the second region. The sole of the shoe may have a flange extending peripherally outward from the shoe upper, and the replaceable sole member may have a toe end peripheral margin substantially equal to a toe end peripheral margin of the sole flange to removably secure the replaceable sole. It is an essential feature of a pair of bowling shoes of this invention, that a single pair of shoes may be adaptable to either a left- or right-handed bowler, or to accommodate other bowler characteristics and/or preferences, simply by attaching a pair of replaceable sole members to the pair to provide the desired relative qualities of slide and/or traction to either shoe of a pair.

This invention is also a method of providing different relative amounts of slide and traction independently to each shoe of a pair of bowling shoes. This embodiment of the invention comprises the following steps. Provide a pair of bowling shoe uppers. Provide a pair of bowling shoe wedge soles, each having a replaceable sole member receiving area. Mount each wedge sole to its respective shoe upper. Provide a replaceable sole member sized and shaped to mate with the replaceable sole member receiving area. Provide the replaceable sole member independently with regions of two different coefficients of friction material. Provide a plurality of such replaceable sole members, with each member independently having relative amounts of the two different coefficient of friction materials different from each other member. Establish the relative amount of slide for one shoe of the pair by securing to one shoe sole a selected replaceable sole member having a chosen amount of two different coefficients of friction of materials to provide slide characteristics. Establish the relative amount of traction for the other shoe of the pair by securing to the other shoe sole a selected replaceable sole member having a chosen percentage of two different coefficients of friction of material to provide traction characteristics. Thus, either shoe of the pair may independently be a slide shoe or a traction shoe, and may have the desired degree of slide or traction, according to the relative amounts of the two different types of materials. The replaceable sole member may be removably attached to the replaceable sole member receiving area, as by a hook and loop fastener material or by adhesive.

DETAILED DESCRIPTION OF THE INVENTION

Figure 1:
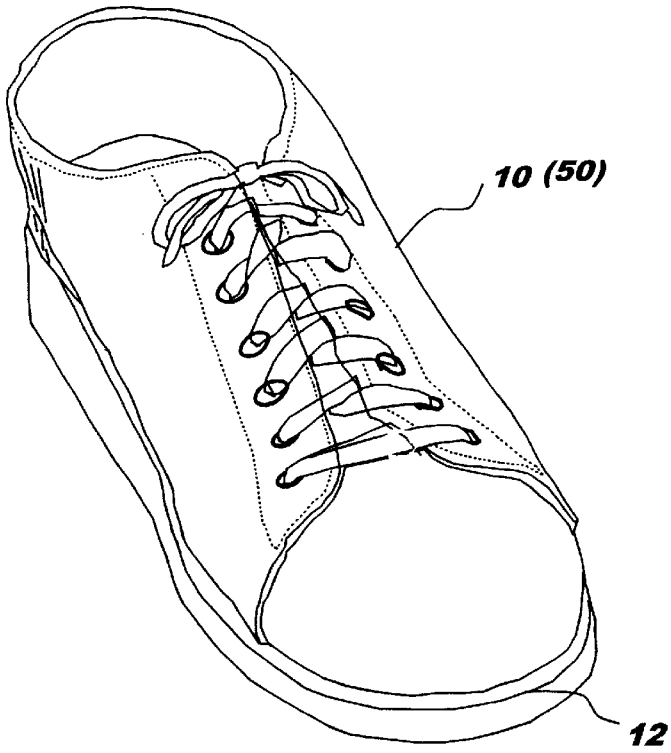
FIG. 1 is a perspective view of the upper of a wedge-soled bowling shoe.

According to the present invention, the relative amount of slide or traction for either shoe of a pair of wedge-soled bowling shoes is determined by the relative percentages of two materials, each of a different coefficient of friction, removably attached to the wedge sole of each respective shoe of the pair. Thus, a selected replaceable sole member is attachable to either shoe of the pair. Each shoe of a pair has a replaceable sole member with two different coefficient of friction materials. A first shoe of a pair is a designated as a traction shoe by having a replaceable sole member with two different coefficients of friction to provide traction characteristics. The second shoe of that pair is designated as a slide shoe by having a replaceable sole member with two different coefficients of friction to provide slide characteristics. Because each shoe is a wedge shoe, the slide or traction action extends along the entire length of the sole, which cannot happen if the shoe has a separate elevated heel. A plurality of replaceable sole members are provided for the left and for the right shoe, with each replaceable sole member having a selected ratio of two different coefficient of friction materials. Changing the relative "slide" or "traction" for either shoe of the pair is accomplished by changing the percentage or ratio of higher to lower coefficient of friction material on the replaceable sole member. Thus, in a pair of shoes of this invention, either shoe may be the slide shoe and either shoe may be the traction shoe, simply by the choice of the replaceable sole members. Similarly, a pair of shoes of this invention may fit a right- or left-handed bowler, simply by the choice of the relative amounts of two coefficients of friction materials on the selected replaceable sole members.

The sole of a wedge-soled bowling shoe of this invention may additionally be partly provided with a permanent sole area and partly with a replaceable sole member receiving area. The permanent sole area may then be constructed of a single material or, alternatively, may be constructed of two regions, each of a different coefficient of friction material. The replaceable sole member receiving area may extend from the toe, or the area adjacent to the toe, to the heel, or the area adjacent to the heel, of the wedge sole and retain a replaceable sole member. When the sole of the wedge-soled bowling shoe has both a permanent sole area and a replaceable sole member, the replaceable sole member and the permanent sole area together cover the entire sole. Each replaceable sole member has two regions of different coefficients of friction materials. The slide shoe has a replaceable sole member with two different coefficients of friction to provide slide characteristics. The traction shoe has a replaceable sole member with two different coefficients of friction to provide traction characteristics. If the permanent sole area has two regions of different coefficient of friction materials, the lower coefficient of friction region preferably extends from the toe and the higher coefficient of friction preferably extends from the heel.

In an alternate embodiment, the permanent sole area may have a flange extending peripherally outward from the shoe upper, and the replaceable sole member receiving area may extend completely from the toe end to the heel end of the wedge sole. In this embodiment, the replaceable sole member may then have a toe end peripheral margin substantially equal to the toe end peripheral margin of the sole flange. The toe end peripheral margin may then optionally include an interior rim conforming to the extending flange. The peripheral margin, with the optional interior rim, aids in removably securing the replaceable sole to the toe end peripheral margin. In conformance with the concept of this invention, a plurality of replaceable sole members, each with two different coefficients of friction to provide slide characteristics or two different coefficients for friction to provide traction characteristics, may be easily interchangeable, being attached to the receiving area by such replaceable means as hook and loop fastening material or adhesive.

In addition, other specific features may be provided to accommodate a specific bowler's preferences. For example, the traction shoe sole may include a wear tip at the front of the sole. The wear tip may have a or high low coefficient of friction surface, according to a bowler's preference, bowling style, and right- or left-handedness. Such tips may be used to prevent the front of the shoe sole or the shoe tip from becoming worn with extended use. Wear may usually arise from two conditions. At the beginning of the approach to the foul line, some bowlers may push off by rolling the traction shoe up so that the tip of the shoe and/or sole may roll up onto the lane surface. Bowlers with this type of approach may generally prefer to have a tip with a high coefficient of friction material, such as natural and synthetic rubber and rubber-substitutes, to add more traction action. Other bowlers, at the end of the approach to the foul line, may slide the traction shoe behind, while sliding forward on the slide shoe. Such bowlers may generally prefer to have a tip with a low coefficient of friction material, such as natural or synthetic leather or leather substitutes or suede or buckskin leather, to add more slide action.

FIG. 11 illustrates a typical wedge-soled bowling shoe 10, in which the sole forms a flat surface continuously from the heel to the toe of the sole. To provide greater stability and balance for the bowler, the shoe 10 may be constructed with a flange 12 of the sole 14 extending peripherally outward.

Figure 2:
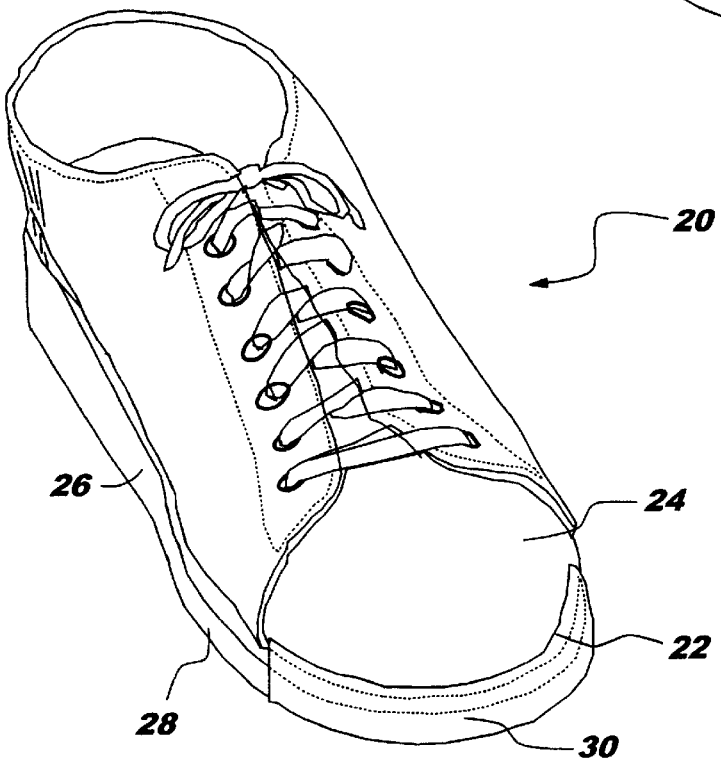
FIG. 2 is a perspective view of the upper of a bowling shoe of this invention, with a replaceable sole member installed.
Figure 3:
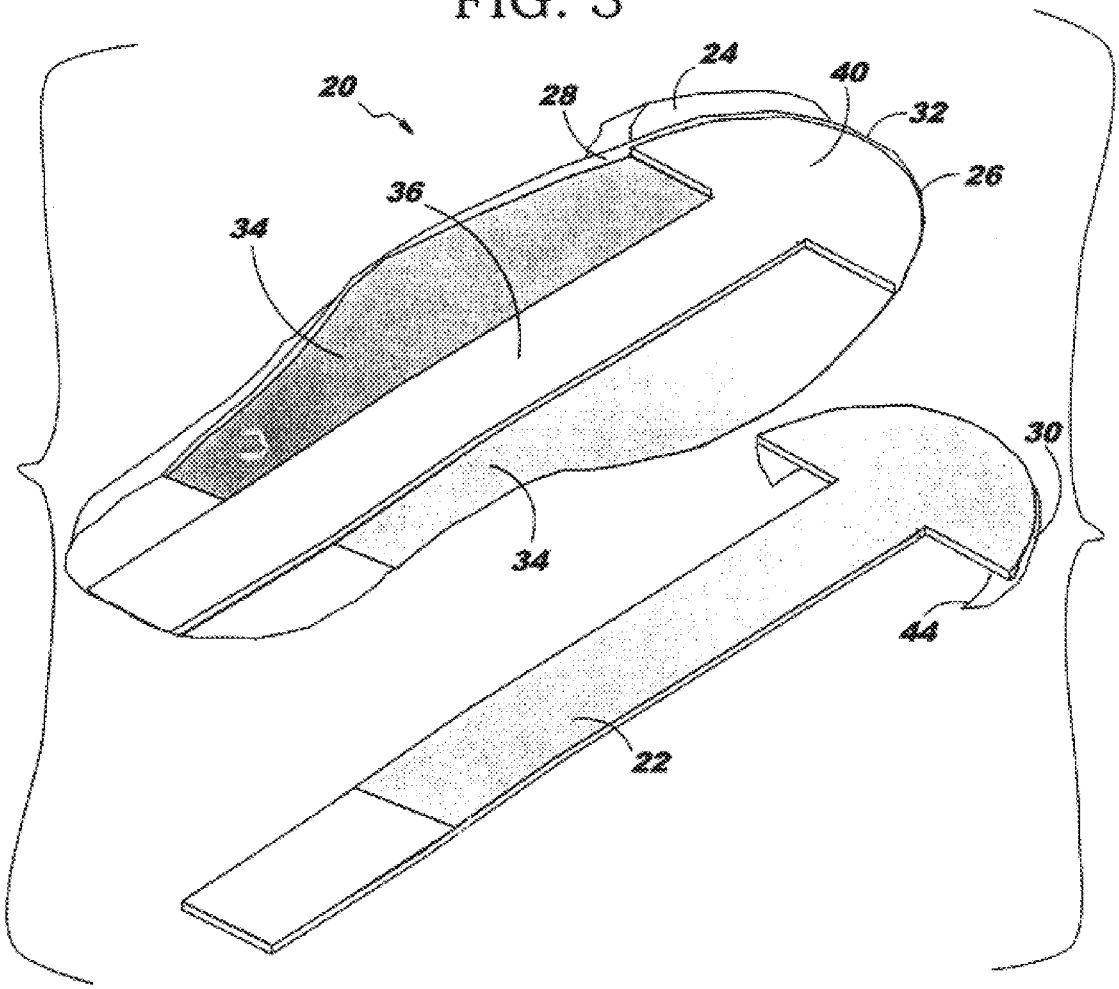
FIG. 3 is a perspective view of the wedge sole of a bowling shoe of this invention, with a replaceable sole member in position to be installed, and showing a hook and loop fastening material for attachment.

An embodiment of a bowling shoe 20 with a replaceable sole member 22 according to this invention will now be described, with reference to FIGS. 2–5, which illustrate a bowling shoe 20 incorporating features of the present invention. The construction and materials of the shoe 20 may be standard or customary in the industry to this type of wedge-soled bowling shoe. FIG. 2 is a perspective view of the upper 24 of a bowling shoe 20 of this invention, with the replaceable sole member 22 installed. As can be seen in FIG. 2, the bowling shoe 20 is a wedge-soled 26 shoe, in which the sole 26 has a flange 28 extending peripherally outward from the shoe upper 24. As can also be seen in FIG. 2, the replaceable sole member 22 has a margin 30 that extends peripherally around the toe 32. The margin 30 covers the flange 28 to conform to and protect the toe end 32 of the flange 28 and to aid in securing the replaceable sole member 22 to the sole 26. FIG. 3 is a perspective view of the wedge sole 26 of a bowling shoe 20 of this invention, with a replaceable sole member 22 in position to be installed. The sole 26 is completely covered by a combination of the permanent sole area 34 and the replaceable sole member receiving area 36. The replaceable sole member receiving area 36 is recessed slightly from the full thickness of the permanent sole area 34.

Figure 4:
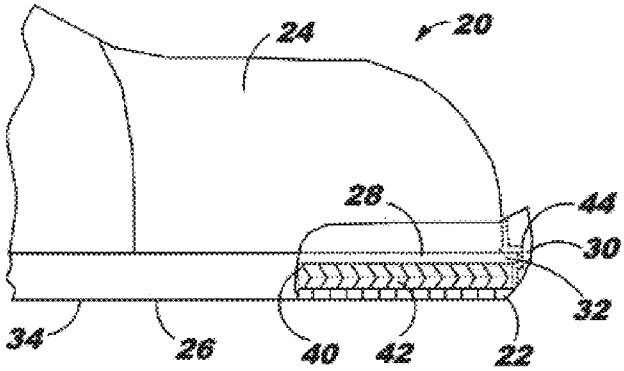
FIG. 4 is a cutaway view of the toe end of the bowling shoe of FIG. 2, with a replaceable sole member installed, showing an interior rim on the sole member to conform to the extending sole flange, and showing a hook and loop fastening material for attachment.

As can be seen in FIG. 3, and in the partially cut-away profile of FIG. 4, the mating faces of the replaceable sole member 22 and the replaceable sole member receiving area 36 are provided with hook and loop fastening material 38. The loop portion 40 may be on the replaceable sole member 22 and the hook portion 42 may be on the recessed replaceable sole member receiving area 36, although the opposite configuration would be equally effective. The hook portion 42 and the loop portion 40 may be affixed to the mating faces by any suitable customary means, such as by adhesive or bonding. As can perhaps best be seen in FIG. 4, by recessing the replaceable sole member receiving area 36 from the full thickness of the permanent sole area 34, the exterior surfaces of the replaceable sole member 22 and the permanent sole area 34 are co-planar. This makes for a firm, secure and comfortable walking surface for the bowling shoe 20, which is vital when approaching the foul line and delivering the ball during bowling.

Figure 5:
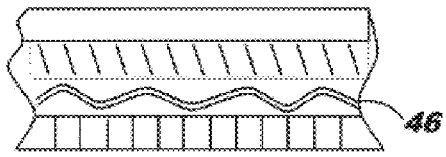
FIG. 5 is a view similar to that of FIG. 4, showing adhesive for attaching mating faces of the replaceable sole member and the receiving area.

As can also be seen in FIG. 4, the margin 30 of the replaceable sole member 22 is interiorly shaped with a rim 44. The rim 44 conforms to the toe end 32 of the extending flange 28, in order to more securely locate and attach the replaceable sole member 22 to the sole 26 of the bowling shoe 20. Although FIG. 4 shows the replaceable sole member 22 as covering only the extending flange 28, it is also within the scope of this invention for the replaceable sole member 22 to extend to cover the toe of the shoe upper 24. FIG. 5 is a view similar to that of FIG. 4, but showing an adhesive 46 for attaching the replaceable sole member 22 to the receiving area 36, instead of the hook and loop fastener material 38. The adhesive 46 may be a fluid product which may be applied to the mating faces of the replaceable sole member receiving area 36 and the replaceable sole member 22, and then the mating surfaces may be firmly and evenly pressed together. Alternatively, the adhesive may be a conventional double-faced adhesive material with treated release paper on each face, which may be cut and sized to match the mating faces. One of the release papers may be removed to firmly affix the double-faced adhesive material to either the replaceable sole member receiving area 36 or the replaceable sole member 22. The other release paper may then be removed and the remaining portion of either the replaceable sole member receiving area 36 or the replaceable sole member 22 may be attached by finely and evenly pressing the mating faces together, as seen in FIG. 5.

Figure 6:
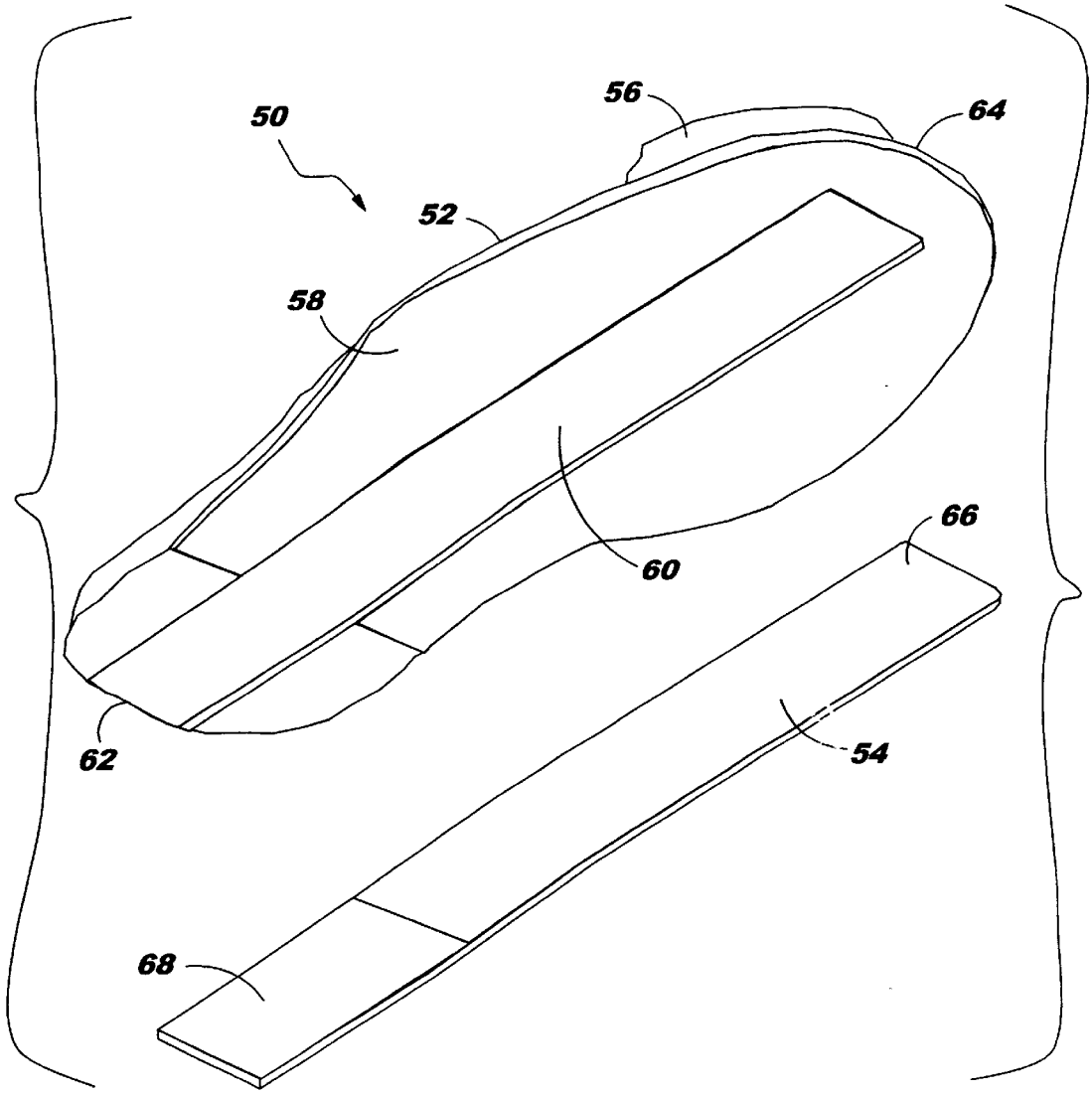
FIG. 6 is a perspective view of the wedge sole of a bowling shoe of this invention, with an alternate embodiment of a replaceable sole member in position to be installed, and showing a hook and loop fastening material for attachment.

An alternative embodiment of the present invention will now be described with reference to FIGS. 1 and 6, which illustrate a bowling shoe 50, incorporating other features of the present invention. The bowling shoe 50 is similar in major respects to the bowling shoe 20, described above, except for the construction of the bottom surface of the wedge sole 52. As can be seen in FIG. 1, the replaceable sole member 54 is not visible when viewing the upper 56 of the shoe 50. FIG. 6 is a perspective view of the wedge sole 52 of the bowling shoe 50, with an alternate replaceable sole member 54 in position to be installed. The sole 52 is completely covered by a combination of the permanent sole area 58 and the replaceable sole member receiving area 60. The replaceable sole member receiving area 60 is recessed slightly from the full thickness of the permanent sole area 58. The sole 52 of the bowling shoe 50 differs from the sole 26 of the bowling shoe 20, in that the permanent sole area 58 covers the sides and toe portions of the periphery of the sole 52. The drawing of the relative sizes and shapes of the permanent sole area 58 to the replaceable sole member receiving area 60 shown in FIG. 6 are for illustration purposes only. The permanent sole area 58 and the replaceable sole member receiving area 60 may be of any relative size and shape, so that together they cover the entire sole 52. It is also within the scope of this invention for the replaceable sole member receiving area 60 to be co-extensive with the entire sole 52, so that there is no permanent sole area 58.

The receiving area 60 extends from the heel 62 to adjacent the toe 64 of the sole 52. The replaceable sole member 54 is similar in major respects to the replaceable sole member 22, described above, except for the construction of the toe end 66. As can be seen in FIG. 6, the toe end 66 of the replaceable sole member 54 is sized and shaped to be closely received by the receiving area 60. The heel end 68 of the alternate replaceable sole member 54 is constructed the same as the replaceable sole member 34 described above. As described above with reference to FIGS. 3–5, the mating faces of the alternate replaceable sole member 54 and the replaceable sole member receiving area 36 may be provided with hook and loop fastening material 38 or with adhesive for attachment.

A plurality of replaceable sole members 22 are designed and adapted to be interchangeable in the replaceable member receiving area 36 on the sole 26 of shoe 20. Similarly, a plurality of replaceable sole members 54 are designed and adapted to be interchangeable in the replaceable member receiving area 60 on the sole 52 of shoe 50. A first sole member 22, 54 of a pair of shoes 20, 50 has a desired ratio of two different coefficients of friction to provide slide characteristics, and a second sole member 22, 54 or a pair of shoes 20, 50 has a desired ratio of two different coefficients of friction to provide traction characteristics. The permanent sole area 34, 58 of each shoe 20, 60 may have a single coefficient of friction material, or may have two regions of different coefficient of friction materials. By choosing the appropriate replaceable sole member 22, 54 to mate with the appropriate shoe 20, 50, a bowler can obtain the desired ratio of "grip" to "slide" of various preferences according to bowling lane conditions and individual characteristics. Also, by choosing the appropriate replaceable sole member 22, 54 to mate with the appropriate shoe 20, 50, the bowler can determine the right- or left-handedness of the pair of shoes. To vary the traction or slide characteristics of the shoe 20, 50, the bowler simply removes one replaceable sole member 22, 54 and replaces it with another replaceable sole member 22, 54 having a surface of a different ratio of the two regions of different coefficients of friction. This gives the shoe 20, 50 different traction or slide characteristics, as required by right- or left-handedness of the wearer, the wearer's preference or characteristics of the surface with which the shoe 20 will be in contact. The replaceable sole member 22, 54 may be constructed of materials with the pre-determined desired coefficients of friction, or the materials may have a surface treatment to establish the desired coefficients of friction. Non-limiting examples of such materials may include natural materials, such as leather and rubber, or synthetic materials, such as synthetic leather and rubber, fabric, or polymers, such as TEFLON™ and nylon, and laminated materials. The basic replaceable sole member 22, 54 may be, for example, molded of a polymer, and the surface materials may be any combination of the previously mentioned materials. In the laminated materials, bonding of the surface material to the replaceable sole member 22, 54 may be by any conventional bonding method suitable for affixing the two materials to each other. Thus, at most only four types of sole materials are required to prepare replaceable sole members 22, 54 to give a theoretically unlimited relative variation of slide and/or traction to either shoe of the pair. By careful selection of the relative amounts of the different coefficient of friction materials, three or even two types of sole materials may be able to be used to provide the desired amount of variation to suit all potential bowlers. The slide shoe will be constructed with a replaceable sole member 22, 54 of two materials to provide slide characteristics, each of a different coefficient of friction. The traction shoe will be constructed with a replaceable sole member 22, 54 of two materials to provide traction characteristics, each of a different coefficient of friction. The replaceable sole member 22, 54 and the permanent sole area 34, 58, if present, may be constructed to be co-planar with each other, respectively. Alternatively, each replaceable sole member 22, 54 may be constructed of two separate elements or pieces, so that each separate element or piece corresponds to one of the regions of the different coefficient of friction materials.

According to yet another embodiment, this invention is a method of providing a desired ratio or percentage of regions of different coefficients of friction materials for a sole of a bowling shoe. The method comprises the following steps. Provide a shoe upper. Provide a wedge shoe sole that has a replaceable sole member receiving area, and that optionally also has a permanent sole area. Extend the replaceable sole member receiving area from the heel end to the toe end of the sole and expand the receiving area to a periphery of the toe end of the sole. Alternatively, extend the replaceable sole member receiving area from the heel end to adjacent the toe end of the sole. Mount the shoe sole to the shoe upper. Optionally, provide the permanent sole area of both sole embodiments with two regions of different coefficients of friction. If a permanent sole area is provided, recess the replaceable sole member receiving area from the thickness of the sole. Provide first and second embodiments of a plurality of replaceable sole members, each sized and adapted to be received closely in the respective receiving area according to the first and second embodiments mentioned earlier in this paragraph.

In another embodiment, extend the replaceable sole member receiving area to be coextensive with the shoe sole. Provide a plurality of replaceable sole members, each sized and adapted to completely cover the entire shoe sole. Construct each one of the plurality of pairs of replaceable sole members with two regions of different coefficients of friction, so that a first sole member of a pair has two different coefficients of friction to provide slide characteristics, and so that a second sole member of a pair has two different coefficients of friction to provide traction characteristics. Each replaceable sole member of a pair is designed and adapted to provide varying relative characteristics of slide and traction according to bowling lane conditions and an individual bowler's preference. Provide mating faces of the replaceable sole member and the corresponding replaceable sole member receiving area with hook and loop fastener material or with adhesive. Removably secure a selected replaceable sole member to the corresponding replaceable sole member receiving area.

Currently available models of bowling shoes only provide a slide surface to a single shoe of the pair. With such models, inventory must include separate pairs of shoes for both right- and left-handed bowlers. The shoe 20, 50 with the replaceable sole member 22, 54 of this invention may be made with a replaceable sole member 22, 54 on one or both shoes of a pair. This will decrease inventory requirements, since either shoe 20, 50 of a pair may have the desired ratio or amount of regions of different coefficients of friction to provide the desired amount of slide or traction, simply by providing the required replaceable sole member 22, 54. Thus, it will be possible to market a pair of shoes 20, 50 along with a plurality of replaceable sole. members 22, 54 of generally preferred ratios of regions of different coefficients of friction, which may be attached and reattached by the individual bowler, according to changing preferences.

For the competitive or avid bowler, amateur or professional, it will also be possible to market a pair of shoes 20, 50 and allow the bowler to select from a larger inventory of replaceable sole members 22, 54 with a wider range of preferred-ratios or percentages of regions of different coefficients of friction or more demanding or personalized requirements. The more casual or beginning bowler typically wears rental bowling shoes that have identical traction surfaces on both shoes, so that right- or-left-handedness of the bowler cannot be accommodated. With the shoe 20, 50 with replaceable sole member 22, 54 of this invention, rental bowling shoes can be made of more economical materials and still allow for the right- or left-handedness of the. individual wearer. This will increase the bowler's control, providing an ability for the casual or beginning bowler to develop greater foot control and to more rapidly increase in skill and enjoyment of the sport. Also, the replaceable sole member 22, 54 will be cost-effective for the rental business, because the useful. life of the shoe 20, 50 will be extended by replacing the replaceable sole member 22, 54 when the surfaces of the sole are worn.

Other bowling shoes currently available which provide replaceable sections of the sole of the shoe, do so by providing a replaceable section of a single material. To change or alter the amount of slide and/or traction of a particular shoe, prior bowling shoes needed to provide replaceable sections in which each section is constructed of a different single material, so that a variety of replicate replaceable sections must be available, each of a different single material. According to the present invention, each replaceable sole member of a pair is constructed with only two different materials, two different types of a slide (or low friction) material and two different types of a traction (or high friction) material. The determination of either shoe as a slide or a traction shoe, as well as the relative amount of slide action or traction action for each shoe, is determined exclusively by the relative amounts or percentages of the two slide materials or the two traction materials on the replaceable sole member of either shoe. Thus, a wide variety of relative slide and/or traction action for the soles of the shoes of this invention can be obtained by using pairs of replaceable sole members constructed of only four different materials, two different types of slide materials and two different types of traction materials. By simply varying the percentages of the two types of slide materials and the percentages of the two types of traction materials, a wide variety of relative slide or traction shoes can be provided. Thus, the manufacturer need use only four different types of sole materials to meet the specific needs of various bowlers. This reduces the cost of inventory of materials and the cost of the shoes to the individual bowler.

The present invention may be embodied in other forms, while retaining its essential characteristics and principles. The embodiments described are intended only to illustrate the present invention and not to restrict it in any way. The scope of this invention is defined by the following claims and not the previous descriptions. The claims include within their range any changes or embodiments within their meaning and scope of equivalency.

That which is claimed is:

1. A wedge-soled bowling shoe with a replaceable sole member comprising:

a bowling shoe upper;

a bowling shoe wedge sole mounted to the shoe upper, the wedge sole having a replaceable sole member receiving area, the replaceable sole member receiving area extending from a toe to a heel of the wedge sole;

a plurality of pairs of replaceable sole members, each member having two surface regions, a first region of a higher coefficient of friction and a second region of a lower coefficient of friction, each member sized and shaped to the replaceable sole receiving area, and each member having a different ratio of regions of different coefficients of friction from each other member; and means for removably securing a selected replaceable sole member to the replaceable sole receiving area, so that securing a first sole member to the replaceable sole area provides a shoe sole with a first ratio of regions of two different coefficients of friction; and so that securing a second sole member to the replaceable sole receiving area provides a shoe sole with a second ratio of regions of two different coefficients of friction;

in which the replaceable sole member and any permanent sole area together cover the entire bowling shoe sole as a tread face, and in which the tread face of the bowling shoe sole is a continuous flat, planar face.

2. A bowling shoe according to claim 1, wherein the sole has a permanent sole area in addition to the replaceable sole member receiving area.

3. A shoe according to claim 2, wherein the replaceable sole member is co-planar with the permanent sole area.

4. A bowling shoe according to claim 1, wherein a region of lower coefficient of friction of the replaceable sole member extends from the toe end and a region of higher coefficient of friction of the replaceable sole member extends from the heel end.

5. A bowling shoe according to claim 1, wherein the replaceable sole member is comprised of two separately attachable sections, a first section corresponding to the first region and a second section corresponding to the second region.

6. A shoe according to claim 1, wherein the shoe sole has a flange extending peripherally outward from the shoe upper, and wherein the replaceable sole member has a toe end peripheral margin substantially equal to a toe end peripheral margin of the sole flange to removably secure the replaceable sole.

7. A shoe according to claim 1, wherein the means for removably securing the replaceable sole member to the replaceable sole member receiving area is selected from hook and loop fastener material and adhesive.

8. A shoe according to claim 1, wherein the two different coefficient of friction regions together provide a relatively greater percentage of lower to higher coefficient of friction regions on the tread face.

9. A shoe according to claim 1, wherein the two different coefficient of friction regions together provide a relatively greater percentage of higher to lower coefficient of friction regions on the tread face.

10. A pair of shoes, each of which is a shoe according to claim 1, wherein a first shoe is a slide shoe and a second shoe is a traction shoe by appropriate selection of the coefficient of friction regions of the replaceable sole member.

11. A pair of shoes according to claim 10, wherein the replaceable sole member of a slide shoe has two different coefficients of friction of regions to provide a relatively greater percentage of lower to higher coefficient of friction regions on the tread face and the replaceable sole member of a traction shoe has two different coefficients of friction of regions to provide a relatively greater percentage of higher to lower coefficient of friction regions on the tread face.

12. A wedge-soled bowling shoe for retaining a replaceable sole member comprising:

a shoe upper;

a wedge shoe sole mounted to the shoe upper, the wedge sole having a replaceable sole member receiving area;

a plurality of replaceable sole members, each member having two surface regions, a first region of a higher coefficient of friction and a second region of a lower coefficient of friction, each member sized and shaped to the replaceable sole receiving area, and each member having a ratio of regions of different coefficients of friction different from each other member;

means for removably securing a replaceable sole member to the replaceable sole receiving area, so that securing a first sole member to the replaceable sole area provides a shoe sole with a first ratio of regions of two different coefficients of friction; and so that securing a second sole member to the replaceable sole receiving area provides a shoe sole with a second ratio of regions of two different coefficients of friction; and in which the replaceable sole member and any permanent sole area together cover the entire bowling shoe sole as a tread face, and in which the tread face of the bowling shoe sole is a continuous flat, planar face.

13. A bowling shoe according to claim 12, wherein a lower coefficient of friction region of the replaceable sole member extends from the toe end and a higher coefficient of friction region of the replaceable sole member extends from the heel end.

14. A pair of shoes, each of which is a shoe according to claim 12, wherein a first shoe is a slide shoe and a second shoe is a traction shoe by appropriate selection of the regions of the replaceable sole member.

15. A pair of shoes according to claim 14, wherein the replaceable sole member of a slide shoe has two different coefficients of friction regions to provide a relatively greater percentage of lower to higher coefficient of friction regions on the tread face and the replaceable sole member of a traction shoe has two different coefficients of friction of regions to provide a relatively greater percentage of higher to lower coefficient of friction regions on the tread face.

16. A replaceable sole member for a wedge-soled bowling shoe, the wedge soled bowling shoe comprising:

a bowling shoe upper;

a bowling shoe wedge sole mounted to the shoe upper, the wedge sole having a replaceable sole member receiving area, the replaceable sole member receiving area extending from a toe to a heel of the wedge sole;

means for removably securing a selected replaceable sole member to the replaceable sole member receiving area, so that securing a first replaceable sole member to the replaceable sole member receiving area provides a shoe sole with a first ratio of regions of two different coefficients of friction; and so that securing a second replaceable sole member to the replaceable sole member receiving area provides a shoe sole with a second ratio of regions of two different coefficients of friction; and in which the replaceable sole member and any permanent sole area together cover the entire bowling shoe sole as a tread face, and in which the tread face of the bowling shoe sole is a continuous flat, planar face;

the replaceable sole member sized and shaped to the replaceable sole member receiving area on the wedge sole of the wedge-soled bowling shoe, the member having regions of two different coefficients of friction; and the replaceable member having means removably securable to the replaceable sole member receiving area;

whereby the replaceable member is interchangeable on the shoe sole with another member having alternate regions of two different coefficients of friction.

17. A replaceable sole member according to claim 16, wherein one of the regions extends from a toe end of the sole and the other of the regions extends from a heel end of the sole.

18. A replaceable sole member according to claim 16, wherein the wedge sole has a flange extending peripherally outward from a shoe upper, and wherein the replaceable sole member has a toe end peripheral margin substantially equal to a toe end peripheral margin of the sole flange to removably secure the replaceable sole.

19. A replaceable sole member according to claim 16, wherein the means for removably securing the replaceable sole member to the replaceable sole member receiving area is selected from hook and loop fastener material and adhesive.

20. A replaceable sole member according to claim 16, wherein the higher and lower coefficient of friction regions together provide a relatively greater percentage of lower to higher coefficient of friction regions on the tread face.

21. A replaceable sole member according to claim 16, wherein the higher and lower coefficient of friction regions together a relatively greater percentage of higher to lower coefficient of friction regions on the tread face.

22. A pair of replaceable sole members, each of which is a replaceable sole member according to claim 16, wherein a first member is a slide member and a second member is a traction member by appropriate selection of the replaceable sole member regions.

23. A pair of replaceable sole members according to claim 22, wherein the replaceable sole member of a slide shoe has two different coefficients of friction which together provide slide characteristics to the shoe and the replaceable sole member of a traction shoe has two different coefficients of friction which together provide traction characteristics to the shoe.

24. A method of providing different relative percentages of slide and traction to each shoe of a pair of wedge-soled bowling shoes comprising:

providing a pair of bowling shoe uppers;

providing a pair of bowling shoe wedge soles each having a replaceable sole member receiving area;

mounting each shoe sole to its respective shoe upper;

providing a plurality of pairs of replaceable sole members, each mated to the replaceable sole member receiving areas, a first member of a pair of replaceable sole members having two regions of different coefficients of friction which together provide a relatively greater percentage of lower to higher coefficient of friction regions on the tread face and a second member of a pair having two regions of different coefficients of friction which together provide a relatively greater percentage of higher to lower coefficient of friction regions on the tread face;

so that the relative amount of slide for a first shoe of the pair is determined by securing to the first shoe replaceable sole member receiving area a selected replaceable sole member having desired relatively greater percentage of lower to higher coefficient of friction regions; and so that the relative amount of traction for a second shoe of the pair is determined by securing to the second shoe replaceable sole member receiving area a selected replaceable sole member having desired relatively greater percentage of higher to lower coefficient of friction regions;

so that either shoe of the pair may independently be a slide shoe or a traction shoe according to the relative percentage of coefficient of friction regions of the selected replaceable sole member; and in which the replaceable sole member and any permanent sole area together cover the entire bowling shoe sole as a tread face, and in which the tread face of the bowling shoe sole is a continuous flat, planar face.

25. A method according to claim 24, wherein the means for removably securing the replaceable sole member to the replaceable sole member receiving area is selected from hook and loop fastener material and adhesive.

* * * * *